239-14.2 $$$ SR
M477G OR 4,593,854

United States Patent [19]

Albertsson

[11] Patent Number: 4,593,854

[45] Date of Patent: Jun. 10, 1986

[54] SNOW-MAKING MACHINE

[76] Inventor: Stig L. Albertsson, P.O. Box 297, Manchester, Vt. 05254

[21] Appl. No.: 603,598

[22] Filed: Apr. 25, 1984

[51] Int. Cl.[4] ..... F25C 3/04; B05B 7/04

[52] U.S. Cl. ..... 239/14; 239/434

[58] Field of Search ..... 239/2 S, 14, 432, 434, 239/240

[56] References Cited

U.S. PATENT DOCUMENTS

| | | | |
|---|---|---|---|
| 2,676,471 | 4/1954 | Pierce, Jr. | 239/2 S X |
| 2,968,164 | 1/1961 | Hanson | 239/2 S X |
| 3,010,660 | 11/1961 | Barrett | 239/434 |
| 3,298,612 | 1/1967 | Torrens | 239/432 X |
| 3,567,116 | 3/1971 | Lindlof | 239/2 S |
| 3,567,117 | 3/1971 | Eustis | 239/2 S |
| 3,606,971 | 9/1971 | Harrison et al. | 239/14 |
| 3,610,527 | 10/1971 | Ericson | 239/2 S |
| 3,703,991 | 11/1972 | Eustis et al. | 239/2 S |
| 3,716,190 | 2/1973 | Lindlof | 239/2 S |
| 3,733,029 | 5/1973 | Eustis et al. | 239/14 |
| 3,760,598 | 9/1973 | Jakob et al. | 239/2 S X |
| 3,774,842 | 11/1973 | Howell | 239/2 S |
| 3,829,013 | 8/1974 | Ratnik | 239/432 |
| 3,873,026 | 3/1975 | Ochs | 239/240 |
| 3,897,904 | 8/1975 | Kiegerl | 239/2 S |
| 3,923,247 | 12/1975 | White | 239/14 |
| 3,945,567 | 3/1976 | Rambach | 239/14 |
| 3,979,061 | 9/1976 | Kircher | 239/2 S |
| 4,004,732 | 1/1977 | Hanson | 239/2 S |
| 4,083,492 | 4/1978 | Dewey | 239/2 S |
| 4,105,161 | 8/1978 | Kircher et al. | 239/2 S |
| 4,202,496 | 5/1980 | VanderKelen et al. | 239/14 |
| 4,214,700 | 7/1980 | VanderKelen et al. | 239/2 S |

FOREIGN PATENT DOCUMENTS

| | | |
|---|---|---|
| 0004803 | 10/1979 | European Pat. Off. . |
| 2358917 | 7/1976 | France . |
| 2376384 | 12/1976 | France . |

OTHER PUBLICATIONS

Hämmerle Snowmaker (undated, 4 pages).

*Primary Examiner*—Joseph F. Peters, Jr.
*Assistant Examiner*—David P. Davidson
*Attorney, Agent, or Firm*—Mandeville and Schweitzer

[57] ABSTRACT

A snow-making machine is disclosed which includes a first group of air-water snow-making nozzles and a second group of airless, water atomizing nozzles. A distributional air fan is driven by a water turbine. Water for the air-water snow-making nozzles is derived from the outlet side of the turbine, while water for the airless nozzles is derived from the intake side of the turbine. A novel construction of air-water manifold ring and air-water nozzles associated therewith is also described. The construction provides a high efficiency, low cost, lightweight snow-making unit, ideally suited for ski area snow-making operations.

7 Claims, 10 Drawing Figures

FIG. 5.
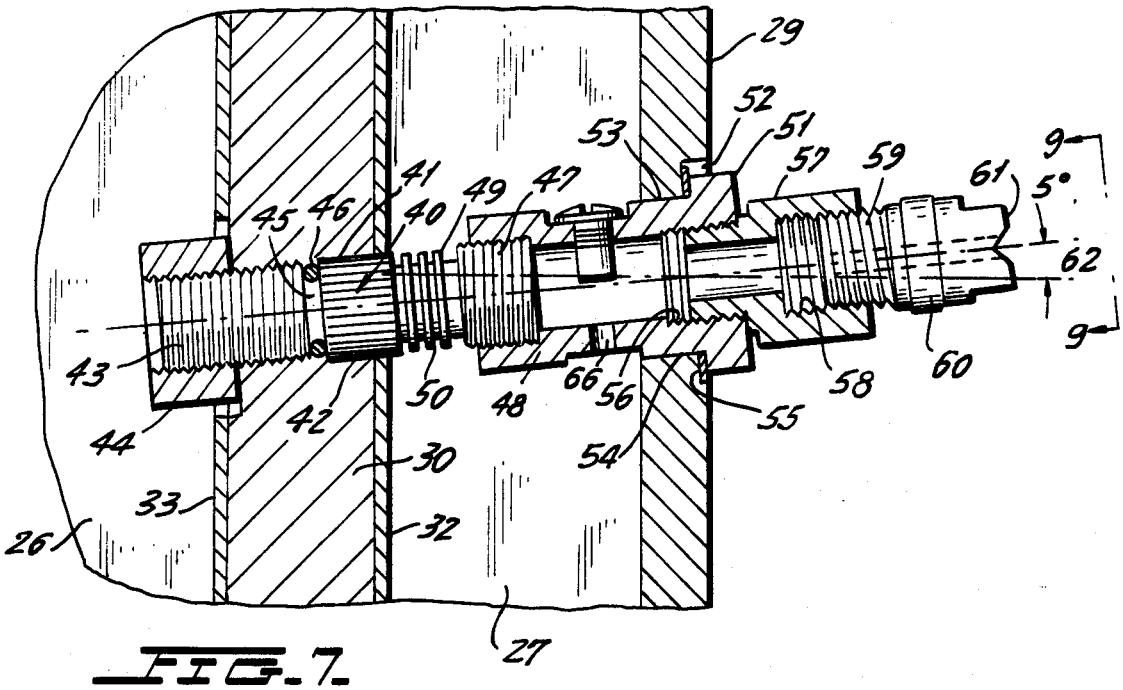
FIG. 7.
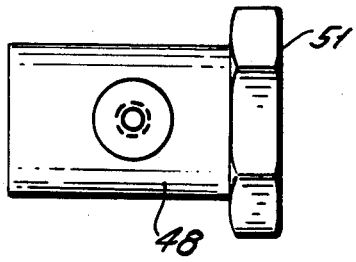
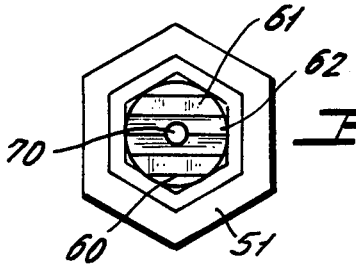
FIG. 9.
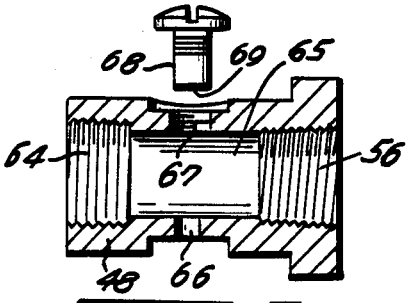
FIG. 6.
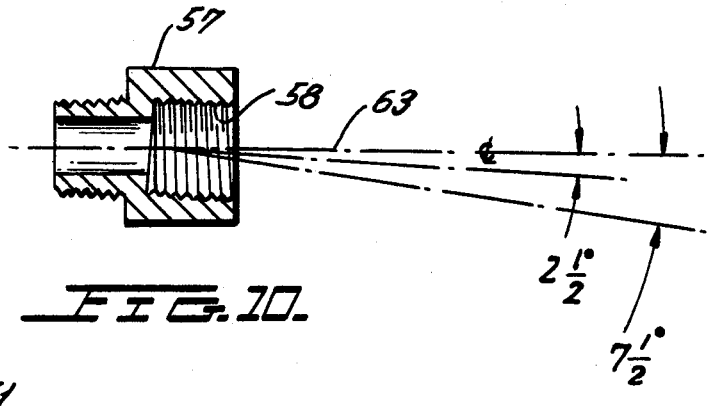
FIG. 10.
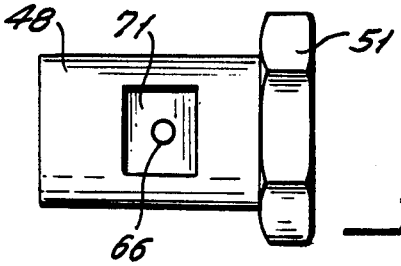
FIG. 8.

SNOW-MAKING MACHINE

RELATED APPLICATION

This application is closely related to and constitutes an improvement over the subject matter of my copending U.S. application Ser. No. 705,042, filed Feb. 25, 1985, which is a continuation of Ser. No. 630,346, filed July 13, 1984, now abandoned, which is a continuation of Ser. No. 360,610, filed Mar. 22, 1982, now abandoned.

BACKGROUND AND SUMMARY OF THE INVENTION

In my above mentioned copending application, an improved snow-making system is described, in which the snow-making procedure at a mountain ski area is made substantially more efficient and economical by incorporating into the snow-making apparatus a turbine-driven fan, which provides a relatively high velocity stream of distributional air into which the atomized water/air mixtures are discharged. The system makes use of the mountain site supplies of pressurized water and air. However, by utilizing the energy available in the pressurized water system to drive a fan for distribution air, important economies can be realized in the snow-making operation itself, and the capital requirements of the installation may be kept at a minimum, as compared to systems of similar snow-making capability.

The apparatus of the present invention makes use of the basic principles of my copending application, in providing for driving of the distribution air fan by means of a turbine motor operating from the pressurized water source prior to its discharge through snow-making nozzles. The apparatus of the present invention, however, further incorporates a number of novel and highly advantageous structural enhancements which add significantly to the snow-making efficiency of the unit and also provide for a great deal of flexibility in the operation of the unit, depending upon ambient conditions.

In accordance with one of the more specific features of the invention, a snow-making apparatus is provided with a novel and advantageous arrangement and orientation of snow-making and nucleating nozzles providing enhanced cooperation and efficiencies in the combined snow-making capabilities of the several nozzles. In this respect, a series of snow-making and nucleating nozzles are arranged about a generally circular manifold structure. The snow-making nozzles are of a type to discharge a somewhat flat (as distinguished from purely circular) spray discharge pattern and these spray patterns are oriented and aimed in an advantageous way to achieve superior snow-making efficiency.

In accordance with another feature of the invention, a unique water-air manifold structure is provided which accommodates direct mounting of the nozzles and which provides advantageously for the bathing of the nozzles, particularly in the area of the air-water intermixing zone, in the water mass of the water manifold. This arrangement significantly reduces the opportunity for nozzle freezeups, which can be a problem with snow-making equipment, particularly at shutdown, when residual water in the system, which is no longer in motion, can quickly freeze up in and around the various nozzle passages and openings.

In accordance with a further aspect of the invention, provision is made in a snow-making apparatus having a water turbine-driven distribution fan, for diversion of some of the water from the inlet side of the turbine to a series of selectively operable water atomizing nozzles arrayed around and generally above the main stream of distribution air and air-water discharge from the various primary snow-making nozzles. The arrangement is such that, when ambient conditions permit (i.e., when temperatures are sufficiently below freezing) some or all of the auxiliary nozzles may be opened to discharge water alone, at high pressures through water atomizing nozzles. This discharge is directed generally into the main stream of distribution air and atomized air-water mixtures and provides for increased delivery of snow, as conditions permit.

For a better understanding of the above and other features and advantages of the invention, reference should be made to the following detailed description of a preferred embodiment of the invention, and also to the accompanying drawings.

DESCRIPTION OF THE DRAWINGS

FIG. 5 is an enlarged, fragmentary cross sectional view illustrating the mounting of atomizing nozzles in the air-water manifold.

FIGS. 6–10 are detailed illustrations of elements of the nozzle assembly forming part of the invention.

DESCRIPTION OF A PREFERRED EMBODIMENT

Figure 1:
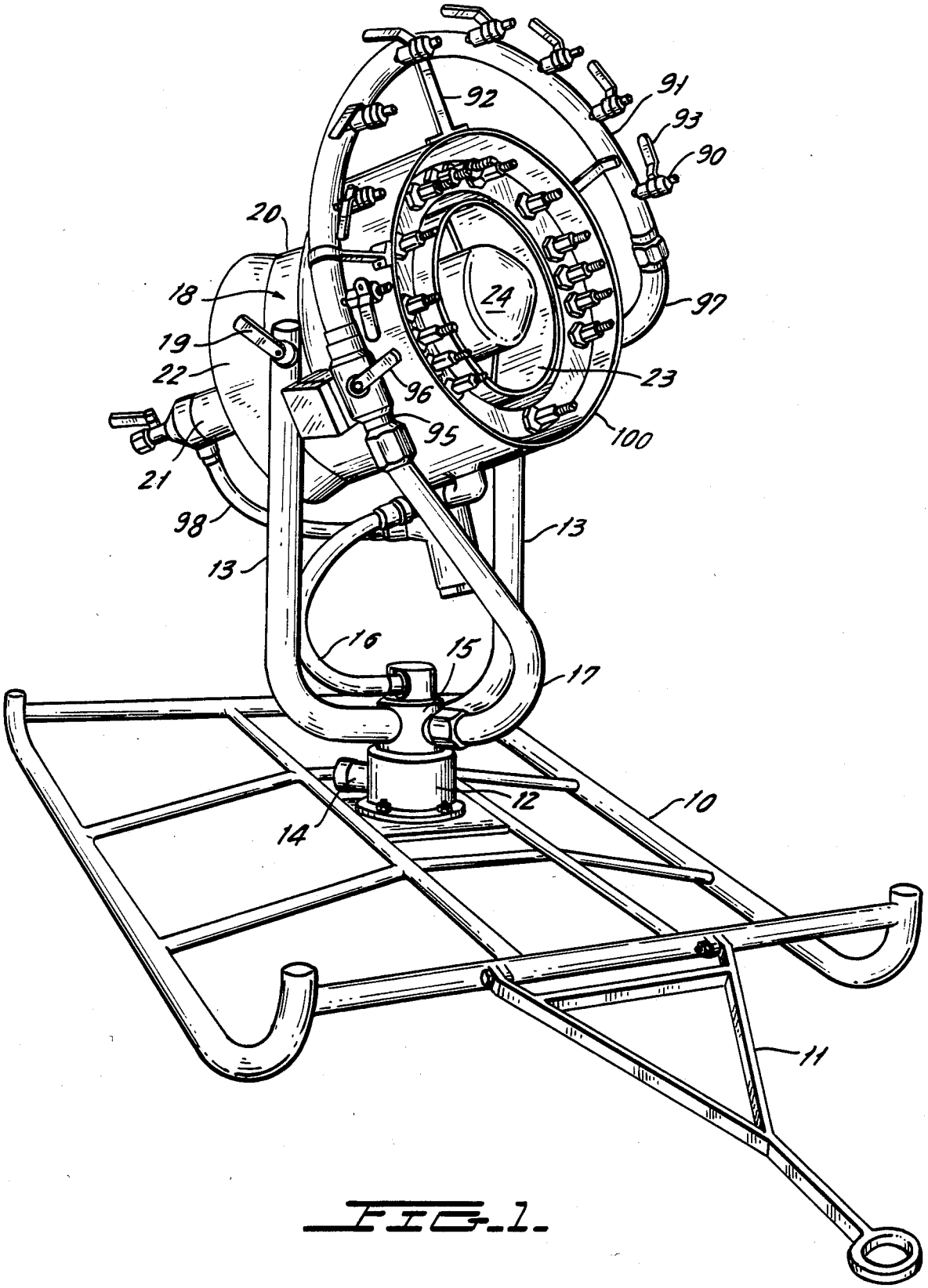
FIG. 1 is a perspective view of a snow-making machine incorporating features of the invention.

Referring now to the drawing, and initially to FIG. 1 thereof, a typical snow-making apparatus according to the invention may include a sled 10 and tow bar 11 to provide mobility around the mountain site. Mounted on the sled 10 is a swivel base 12 on which is mounted a yoke 13 arranged for unlimited swiveling movement about a vertical axis. Water and air inlets, of which air inlet 14 is illustrated, are provided in the base 12, which is fixed to the sled. A rotary element 15, which is mounted on the base 12 and carries the yoke elements 13 is also provided with air and water outlet conduits 16, 17 which lead to the snow-making equipment.

The snow-making unit, generally designated by the reference numeral 18, is mounted by the yoke members 13 for tilting movement about a horizontal axis, being secured in an adjusted position by means of a locking handle 19.

The snow-making unit includes a main shroud 20 which mounts and encloses a fan F (FIG. 2) driven by a water turbine 21. At the rear, the housing has an outwardly flared skirt 22 forming an air intake. When the system is in operation, a relatively high velocity distributional airflow is provided by the tubine driven fan and is directed forwardly, through the annular discharge opening 23 at the forward end of the main shroud 20. In the particular embodiment shown, the shroud 20 also encloses a central housing 24 for a tachometer generator or similar device for measuring the speed of the fan when the system is in operation.

Figure 4:
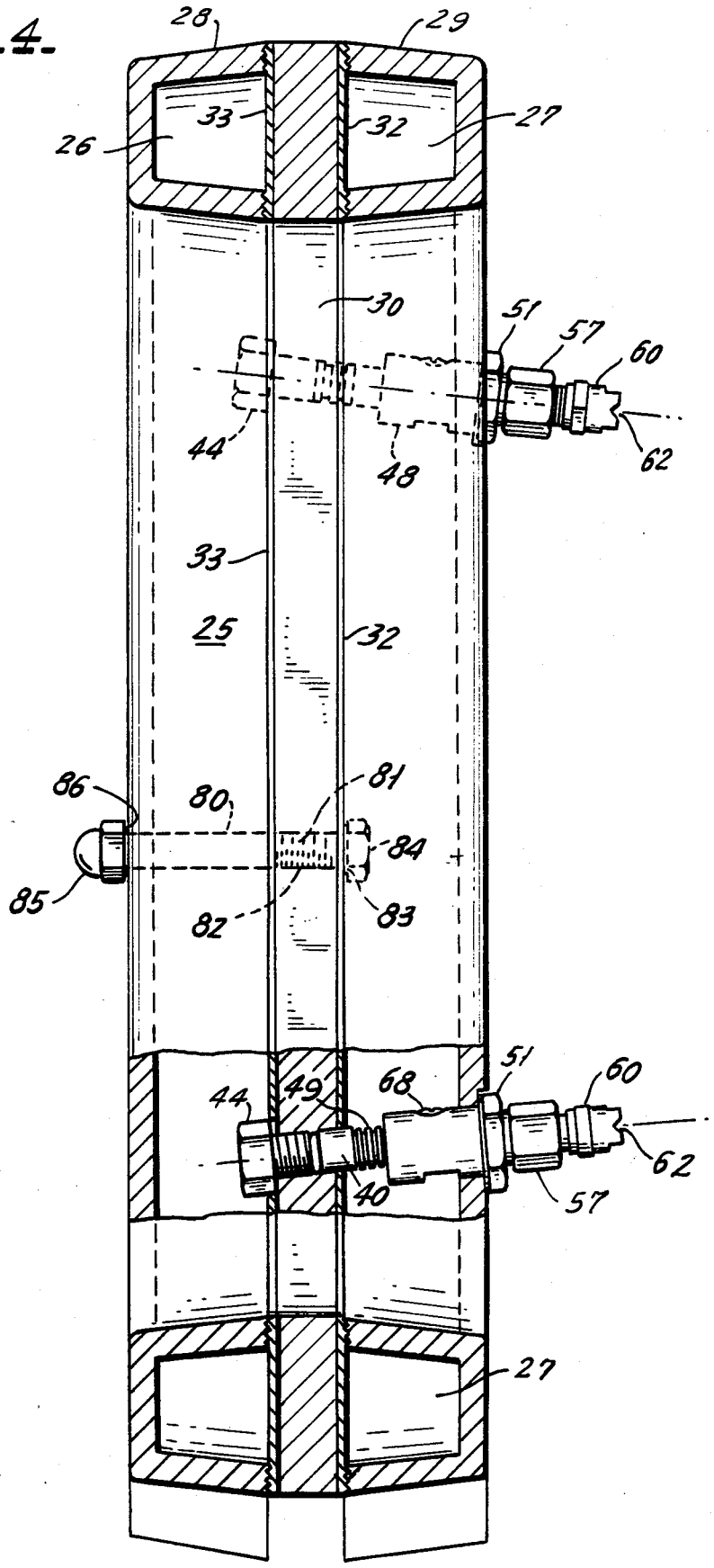
FIG. 4 is an enlarged, cross sectional illustration of the water-air manifold, as taken generally on line 4—4 of FIG. 3.

Mounted concentrically around the forward portion of the main shroud 20 is an annular air/water manifold ring 25 having annular manifold chambers 26, 27 for air and water respectively (see FIG. 4). In accordance with one aspect of the invention, the manifold 25 is constructed of a pair of annular castings 28, 29 of open sided, U-shaped cross section. These are arranged, as shown in FIG. 4, to form facing front and rear housings. An annular separating ring 30 is positioned between the respective front and rear manifold housings, and resilient sealing rings 31, 32 are provided at the interfaces between the separating ring and the respective housings, to form fluid tight seals. Thus, when the front and back manifold housings 28, 29 are clamped securely to the separating ring 30, the annular manifold chambers 26, 27, for air and water respectively are formed. Water and air inlet connections are provided to the manifold at 34, 35 (see FIG. 2). These respective inlet connections are oriented at the bottom of the manifold to accommodate drainage at shut down.

Assembly of the manifold 25, and mounting of the various nozzles thereon, involves certain unique and advantageous features to be described in more detail. The various nozzle assemblies, whether nucleating nozzles or regular snow-making nozzles, are generally in the form illustrated in FIGS. 5–10. Each nozzle includes an air tube 40 arranged to be received in a bore 41 in the manifold separating ring 30. The bores 41 advantageously are arranged at a slight angle to the central axis of the manifold ring, such that the nozzles converge toward the central axis at an angle of approximately five degrees thereto. The arrangement is such that the axes of all of the bores 41 nominally converge with the central longitudinal axis at a common point spaced well in front of the snow-making equipment. As will be later described, however, the nozzles themselves are oriented somewhat differently, to avoid convergence at a common point.

As illustrated in FIG. 5, the central section 42 of the air tube 40 is of smooth cylindrical form and is arranged to fit snugly within the bore 41. The rearward end 43 of the tube is threaded, as shown at 43 and is arranged to project slightly into the air manifold chamber 26, to receive a nut 44. An annular groove 45 is formed between the cylindrical central section 42 and the threaded rear section 43 and receives a resilient O-ring 46. The O-ring forms an effective barrier to prevent leakage of air or water along the passages 41, between the air and water manifold chambers 26, 27.

A portion of the air tube 40 projects into the water chamber 26 and, at its forward extremity 47, the air tube is threaded for engagement with a mixing sleeve 48. To the rear of the threaded portion 47 is a short section 49 which is exposed directly to the interior of the water chamber 26, and that section advantageously is provided with heat transfer fins 50 to optimize heat exchange with the ambient water in the manifold 26.

The mixing sleeve 48 is provided at its forward end with a flange 51, desirably of hexagonal shape to accommodate engagement by a wrench or other tightening tool. The flange is received in a recess 52 in the front face of the water manifold housing 29, and a cylindrical portion 53 of the sleeve, located just behind the flange 51, is received in a through bore 54 in the front face of the water manifold. The bore 54 is aligned at the same angle as the bore 41 in the separating ring, to provide for the approximately five degrees of nominal convergence of the nozzle mounting assembly.

A fluid tight seal is provided between the mixing sleeve 48 and the manifold housing 29 by means of a soft metal washer 55 which is positioned under the flange 51.

At the forward end of the mixing sleeve, internal threads 56 are provided which receive an adapter nipple 57. The nipple is itself provided with internal threads 58 at its forward end for engagement with the threaded end section 59 of a snow-making nozzle 60. The nozzle 60 may be a standard, commercially available snow-making nozzle, advantageously a Veejet nozzle as made available by Spray Systems Inc. One feature of this nozzle is the provision in its front face 61 of a transverse, V-shaped groove 62 which tends to shape and flatten somewhat the dicharged air-water mixture.

In accordance with one aspect of the invention, certain of the adapter nipples 57, shown in detail in FIG. 10, are provided with internally threaded forward sections 58 aligned along axis disposed at an angle to the primary axis 63 of the nozzle holder assembly. To provide for an optimum pattern of nozzle orientation about the manifold ring 25, several forms of adapter nipples are provided, with different angular orientation of the forward threaded section 58. By appropriate selection of the adapters, and appropriate rotational orientation thereof, the individual nozzles may be aligned at different angles with respect to the central axis of the snow machine, while permitting all of the nozzle mounting assemblies to be arranged at a common angle of convergence, for simplification of the manufacturing and assembly operations.

As shown in FIGS. 6–8, the mixing sleeve 48 is provided between front and rear threaded sections 56, 64 with a mixing chamber section 65. A water inlet bore 66 is provided in the wall of the sleeve 48 and, as shown in FIG. 5, the bore 66 communicates with the interior of the water manifold cavity 27 such that ambient water under pressure within the cavity can directly enter the mixing sleeve at high velocity through the small passage 66. Directly opposite the water passage 66 is a threaded bore 67 arranged to receive an anvil screw 68, which projects well into the mixing chamber 65 and is provided with an anvil-forming end surface 69 positioned to intercept the high pressure water stream flowing into the mixing chamber through the passage 66 to assist in breaking up the water stream and initiating the process of mixing and atomizing the water. In the operation of the system, air under pressure is simultenaously entering the mixing chamber 65 through the hollow air tube 40, providing for a highly turbulent intermixing of water and air within the chamber 65. This turbulent mixture then flows through the adapter nipple 57 and into the inlet of the nozzle 60, to be discharged at high velocity through the nozzle opening 70 in a somewhat flattened spray pattern determined by the orientation of the nozzle axis and the rotational orientation of the V-shaped front groove 62.

To great advantage, the orientation of the mixing sleeves 48 in the air-water manifold 20 is in all cases such that the water passage 66 faces vertically downward to accommodate drainage of the nozzle assembly upon shut down of the equipment. In addition, a flat surface 71 is milled in the outer wall of the mixing sleeve 48 to reduce the length of the water inlet passage 66. This both reduces the likelihood of freeze up upon shut down, and facilitates remelting and/or break out of any ice blockage in this passage when the equipment is started up, by reason of both the reduced thickness and the direct exposure of this area to the ambient body of water within the water manifold cavity 27.

As shown in FIG. 4, securement of the front and back manifold housings 28, 29 to the central separating ring 30 is accomplished by means of a plurality of circumferentially spaced bolts 80, securing the air manifold housing 28 to the separating ring 30, and by means of the several nozzle assemblies, which serve to secure the front or water manifold housing 29 to the separating ring. In the assembly procedure, a plurality (typically six) of the clamping bolts 80 are initially inserted into the separating ring 30, and these bolts are provided with threaded portions 81 adjacent the head for threaded engagement with bores 82 in the separating ring 30. A soft metal washer 83 underlies the head 84 of each bolt such that, when the bolts are tightened down against the separating ring 30, a tight seal is formed, and the bolts are locked relatively tightly in place, with their ends projecting through the ring and rearwardly.

After installation of the bolts 80, but before installation of the air manifold housing 28, the front manifold housing 29 is secured in place by means of the several nozzle assemblies. As reflected in FIG. 5, for example, an assembly air tube 40 and mixing sleeve 48 is inserted from the front of the manifold housing 29, through aligned bores 54, 41 in the housing 29 and separating ring 30 respectively. When the flange 51 and washer 55 are seated in the recess 52, the threaded end 43 of the air tube projects slightly rearwardly beyond the back face of the separating ring 30 for reception of the nut 44. When all of the air tube-mixing sleeve assemblies are in place, the nuts 44 can be tightened down, securely clamping the front manifold housing 29 into the separating ring and forming a sealed chamber. During this operation, the mixing sleeve 48 are oriented with their respective water inlet passages 66 facing downward, and an appropriate index mark may be provided on the exterior of the flange 51 for this purpose.

After assembly and tightening of the front manifold housing 29, the rear housing 28 may be placed over the projecting bolts 80, which are sufficiently long to project slightly through the back face of the housing. Cap nuts 85 or the like, together with soft metal washers 86, are applied to tightly secure the housing 28 in the separating ring 30 to complete the assembly of the manifold unit 25.

Figure 3:
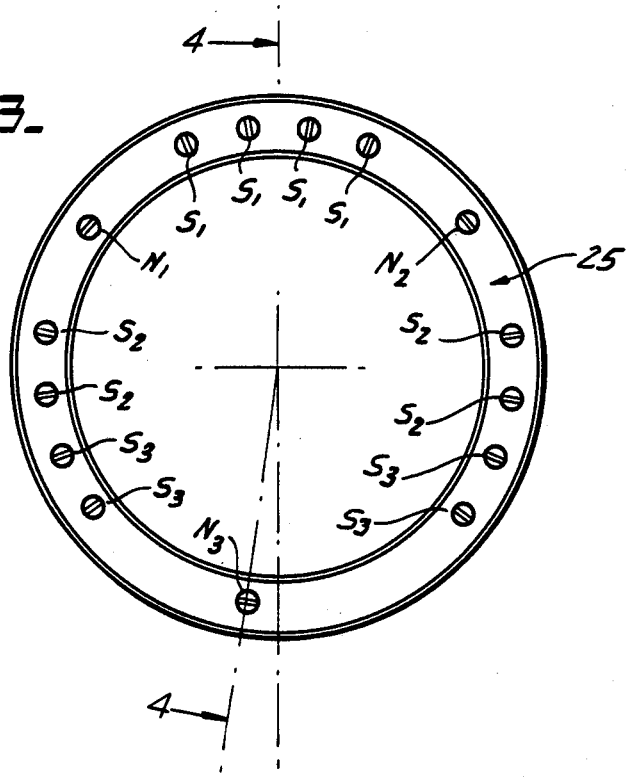
FIG. 3 is a front elevational representation of the water-air manifold and the orientation of nozzles mounted thereon.

Snow-making efficiency can be enhanced by proper aiming of the several nozzle assemblies, as well as proper orientation of the spray fans which are issuing therefrom. In the illustrated arrangement, there are three nucleating nozzle assemblies N1, N2 and N3 (see FIG. 3) spaced more or less uniformly around the manifold ring 25, with the nozzle N3 near the lower extremity of the ring, and the nozzles N1, N2 spaced about 60° on either side of the upper vertical. The adapter nipples 57 for the three nucleating nozzles are arranged such that their nozzle-mounting sockets 58 are angled at approximately seven and one half degrees from the primary axis of the nozzle assembly. In the case of the upper nucleating nozzles N1, N2, these adapter nipples are oriented to tilt the respective nozzles radially outward. And, since the primary nozzle assemblies are initially directed at a five degree convergent angle, the net result is an approximate two and a half degree radially outward divergence of the nucleating streams from these two nozzles. In addition, the orientation of the Veejet nozzle groove 62 is more or less circumferential, as shown in FIG. 3. These two upper nucleating nozzles serve to provide nucleation for the main air-water snow-making nozzles and also for a series of water jet nozzles 90, which are mounted on a water ring manifold 91 extending circumferentially around the upper portion of the manifold ring 25, spaced radially outward therefrom.

The seven and a half degree adapter nipple 57 for the lower nucleating nozzle N3 is oriented to the inside, such that, taking into account the initial five degree convergence of the primary nozzle assembly, its nozzle element is directed upward at approximately twelve and a half degrees to the central longitudinal axis of the snow maker.

In the upper portion of the manifold ring 25 are four spaced snow-making nozzle assemblies S1. These assemblies are provided with adapter nipples 57 providing for an approximately two and a half degree canting of the nozzle assemblies, and the orientation of these nipples is such as to cant radially outward. The two and a half degree outward cant, in conjunction with the five degree initial convergence of the nozzle assemblies provides, for an approximate two and a half degree convergence of the jets issued by these respective nozzles S1. Likewise, the nozzle elements 60 of the nozzle assemblies S1 are oriented to provide for the Veejet grooves 62 to be oriented more or less radially, and this is true with respect to all of the air-water snow-making nozzles in the illustrated arrangement.

At each side of the manifold ring 25, at approximately the mid level thereof, are provided pairs of snow-making nozzle assemblies S2. The adapter nipples 57 for these nozzle assemblies are straight through, such that the nozzle elements themselves discharge at the primary five degree convergence angle at which the nozzle assemblies are mounted in the manifold housing.

Slightly below the nozzle S2 are opposed pairs of snow-making nozzle S3, in the lower quadrants of the manifold ring. The adapter nipples for the lower quadrant nozzles S3 are angled at two and a half degrees to the main axis and are oriented radially inward, such that the lower quadrant nozzles S3 are directed convergently at an angle of about seven and a half degrees.

Although the specific nozzle pattern illustrated and described above is by no means critical, it has been found to produce highly effective results under typical snow-making conditions.

Figure 2:
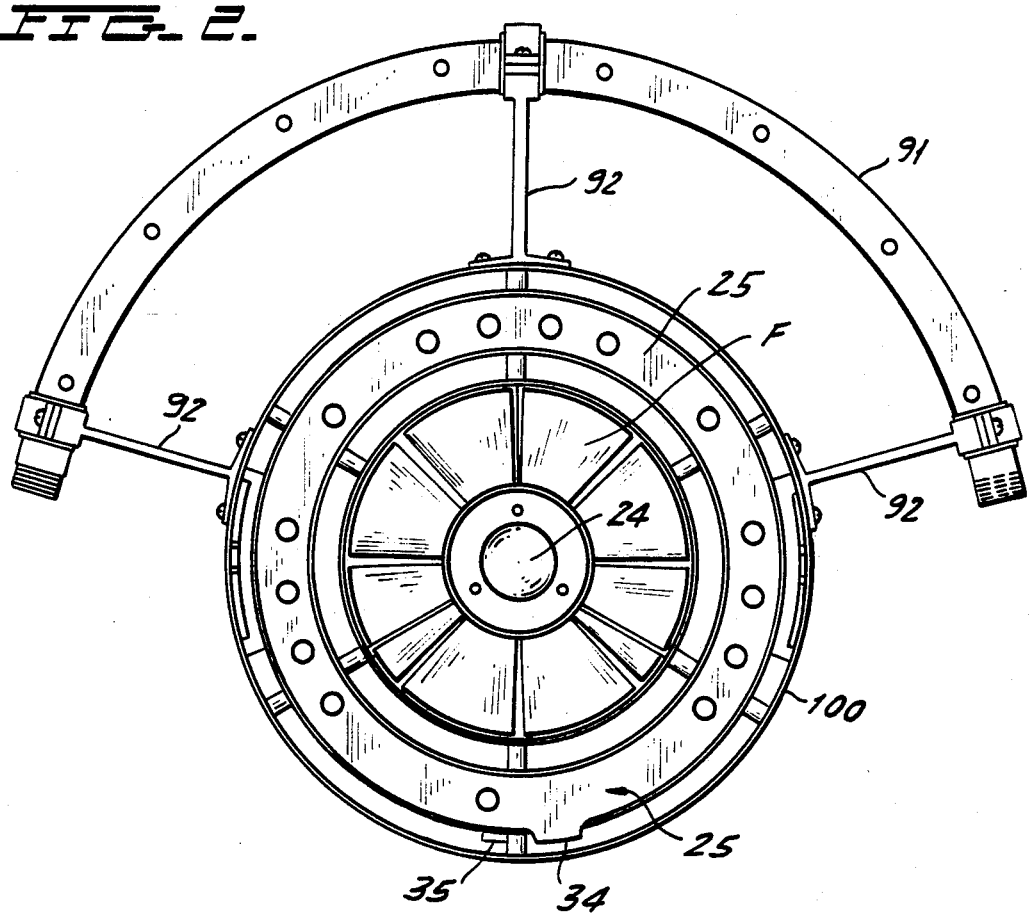
FIG. 2 is a front elevational view of a subassembly of the apparatus of FIG. 1, illustrating the arrangement of water-air manifold, surrounding shroud and surrounding water ring.

As illustrated in FIGS. 1 and 2, the water ring manifold 91 is secured to the main structure by means of brackets 92 extending from a noise containment shroud 100 surrounding the main manifold housing 25 and the nozzles mounted thereon. The water ring manifold 91 extends over a working arc of slightly less than 180°, over the upper quadrants of the manifold housing 25. In one advantageous embodiment of the invention, wherein the primary nucleating and snow-making nozzles on the manifold housing 25 are spaced around ten inches from the central axis of the snow-making unit, the water ring manifold 91 was mounted on a radius of about twenty inches from that axis. In the illustrated arrangement, the water ring manifold mounts a series of eight nozzles 90, each provided with an individual on-off valve 93. The nozzles 90 are water atomizing only—that is, there is no provision for premixing with air. These nozzles are used selectively as ambient conditions permit. In other words, in marginal snow-making conditions, the water ring nozzles 90 might be not used at all. With progressively lower ambient temperatures, water ring nozzles may be selectively opened, at the discretion and judgment of the machine operator, to provide for increased snow-making capacity.

Since the water ring nozzles 90 rely exclusively on water pressure for atomization, the apparatus of the present invention provides for delivery of water to the ring manifold 91 upstream of the water driven turbine 21. To this end, the water supply conduit 17 connects directly to one end 95 of the water ring manifold through a main on-off valve 96. At its downstream end, the water ring manifold 91 joins with a conduit 97, which is connected with an inlet conduit 98 for the water turbine 21. As described more fully in my before mentioned copending application, the air/water nozzles, mounted on the manifold ring 25, receive water at a somewhat reduced pressure, from the exhaust side of the turbine 21.

In the operation of the apparatus of the invention, the unit is towed to the snow-making site, typically by a snow cat. In this respect, however, the apparatus of the invention is very light in weight, in relation to its performance, with a typical apparatus weighing less than 400 pounds. Accordingly, a single unit may be easily moved by a snow mobile. Snow cats, being more powerful can easily tow several snow-making machines.

lower end of this range, the effective water pressure at the turbine is approximately 100 psi, and this results in the discharge of approximately fourteen gallons per minute of water from the various nozzles on the manifold housing 25, in conjunction with approximately 420 cfm of compressed air (air always being measured at a pressure of about 94 psi). This would represent an extreme set of conditions, with barely marginal snow-making capability. If ambient conditions admit, water pressure at the turbine motor 21 may be increased up to the maximum (for the particular installation) of about 350 psi, achieving fan rpms of approximately 4800. Under these conditions, approximately 54 gallons per minute is issued from the primary manifold nozzles, along with air consumption of about 368 cfm. Ambient conditions permitting, if individual valves 90 of the water ring manifold are open, approximately ten gallons per minute of water flow is added for each such valve opened, with no additional consumption of compressed air. Thus, the equipment provides for a high degree of flexibility in use, so that maximum advantage may be taken of ambient conditions to achieve optimum operating efficiencies.

The chart of air and water flow data set forth below reflects typical consumptions of water and compressed air at various operating speeds, in an apparatus of the type specifically illustrated and described herein.

AIR AND WATER FLOW DATA
Flow U.S. G.P.M. at 94 PSI Air Pressure

| RPM | Air/Water Ring | No. of Outer Ring Valves Open 1 | 2 | 3 | 4 | 5 | 6 | 7 | 8 | Water Pressure PSI | AIR CFM 94 PSI |
|---|---|---|---|---|---|---|---|---|---|---|---|
| 1900 | 14 | 21 | 27 | 34 | 40 | 47 | 54 | 60 | 67 | 100 | 420 |
| 2850 | 26 | 33 | 40 | 48 | 55 | 62 | 69 | 77 | 84 | 150 | 403 |
| 3400 | 34 | 42 | 50 | 58 | 67 | 75 | 83 | 91 | 99 | 200 | 392 |
| 4000 | 43 | 52 | 60 | 69 | 77 | 86 | 94 | 103 | 111 | 250 | 381 |
| 4500 | 50 | 59 | 68 | 77 | 87 | 96 | 105 | 114 | 123 | 300 | 372 |
| 4800 | 54 | 64 | 74 | 84 | 94 | 104 | 114 | 124 | 134 | 350 | 368 |

At the snow-making site, the equipment is connected in the usual way to the mountain site sources of compressed air and water. To start up the equipment, the main water valve 96 is opened slowly. As soon as the turbine motor 21 begins to operate and drive the distributional air fan, the main compressed air valve may be opened. The operator then adjusts the fan speed (by control of water flow) until the desired quality of snow is being produced. In this respect, the more favorable the ambient conditions, the higher the ratio of water to compressed air that can be tolerated to achieve quality snow. This is to a large extent, although not exclusively, a function of ambient temperature. If snow-making conditions are such as to accommodate full operating speed of the turbine motor 21, the operator may commence to turn on the water ring nozzles 90 one at a time, as long as the snow being produced is of adequate quality.

In the illustrated form of apparatus, the three nucleating nozzles N1–N3 are adjusted to issue approximately one third gallon per minute of water in conjunction with approximately 25 cfm of air (measured at about 94 psi). This promotes a highly efficient crystal formation from these nozzles which, according to known principles, stimulates crystal formation in the atomized streams issuing from other nozzles.

Depending upon ambient conditions, the turbine driven fan may be operated at rpms ranging from a low of approximately 1900 up to approximately 4800. At the The apparatus of the invention provides for a commercially advantageous unit for mountain site snow-making operations, which, in relation to its performance capabilities, is lightweight and inexpensive and, perhaps more important, enables substantial economies to be realized in the overall cost of man-made snow at commercial ski areas. Because the unit of the present invention effectively enables the mountain site pressurized water system to be utilized in the driving of a distributional air fan, a high efficiency, high capacity snow-making unit may be provided at a fraction of the expense of a more conventional commercial unit. The unit of the invention also involves a fraction of the weight of the more conventional units and thus can be more easily moved from place to place at the mountain site for more complete and effective snow coverage.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A snow-making apparatus which comprises (a) an air-water manifold ring comprising front and rear annular manifold chambers for water and air, respectively, (b) a plurality of nozzle assemblies mounted on said manifold ring and having portions extending through the front manifold chamber and portions extending into said rear manifold chamber, (c) an air-water mixing element in each of said nozzle assemblies in the portions thereof within said front chamber, (d) said nozzles discharging air-water snow-making mixtures in a generally forwardly direction from the front face of said manifold ring, (e) said manifold ring comprising front and back chamber-forming housings and a separating ring interposed between said chamber-forming housings, (f) said nozzle assemblies including portions extending through said front chamber-forming housing and through said separating ring, (g) said nozzle assemblies each comprising an air tube member and a mixing sleeve connected thereto, (h) said air tube member extending through said separating ring and communicating with said rear annular manifold chamber chamber, (i) said mixing sleeve extending through said front housing and communication with said front annular manifold chamber with said air tube, (j) said mixing sleeve having an inlet opening therein communicating with the interior of said front annular manifold chamber.

2. A snow-making apparatus according to claim 1, further characterized by (a) said front chamber-forming housing and said separating ring being secured together in chamber-forming relation by said nozzle assemblies.

3. A snow-making apparatus according to claim 1, further characterized by (a) said mixing sleeve being generally tubular in form and having means at one end for connecting with said air tube, (b) said mixing sleeve inlet opening comprising an opening in the side wall of said sleeve, (c) said opening facing vertically downward, (d) an anvil-forming member in said mixing sleeve, positioned generally opposite said inlet opening to intercept the water stream entering said mixing sleeve through said inlet opening.

4. A snow-making apparatus which comprises (a) air-water manifold means comprising manifold chambers for water and air, (b) a plurality of nozzle assemblies mounted on said manifold means and having portions extending through the water manifold chamber and portions extending into said air manifold chamber, (c) an air-water mixing element in each of said nozzle assemblies in the portions thereof within said water manifold chamber, (d) said nozzles discharging air-water snow-making mixtures in a generally forwardly direction, (e) said nozzle assemblies being arrayed generally in a circular pattern around a central axis, (f) distributional air fan means for directing distributional air generally along said axis, (g) water turbine means driving said air fan means, (h) pressurized water supply means supplying water in series to said water turbine means and to said water manifold chamber, (i) a secondary manifold ring disposed about the upper quadrant portions of said circular nozzle pattern, (j) said secondary manifold ring mounting a plurality of water atomizing nozzles thereon for supplementary operation in conjunction with said first mentioned nozzle means, (k) said pressurized water supply means comprising outlet means of said secondary manifold ring, (l) whereby said first mentioned nozzle means is supplied with water from the downstream side of said water turbine means and said water atomizing nozzles are supplied with water from the upstream side of said water turbine means.

5. A snow-making apparatus according to claim 4, further characterized by (a) said plurality of nozzle assemblies including selected spaced ones thereof adapted to function as nucleating nozzles, (b) said nucleating nozzles being directed to discharge in a slightly upward direction with respect to said central axis to provide nucleation for said water atomizing nozzles.

6. A snow-making apparatus according to claim 5, further characterized by (a) said plurality of nozzle assemblies including selected additional ones thereof adapted to function as snow-making nozzles, (b) said snow-making nozzles being arranged in groups between said nucleating nozzles, (c) said nozzles having V-shaped grooves for shaping the discharge pattern thereof in a somewhat flattened pattern, (d) the grooves in said nucleating nozzles being oriented generally in a circumferential direction and the grooves in said snow-making nozzles being oriented generally in a radial direction.

7. A snow-making apparatus according to claim 6, further characterized by (a) said nozzle assemblies including adapter elements and nozzle tip elements, (b) said adapter elements having angularly directed socket means for the reception of said nozzle tip elements, (c) said nozzle assemblies including principal nozzle mounting means disposed at a slightly converging angle to said central axis, (d) said adpater elements being adapted for rotational orientation relative to said principal nozzle mounting means, whereby said nozzle tip elements may be adjustably oriented with respect to said central axis.

* * * * *